US007285522B2

(12) United States Patent
van Buskirk

(10) Patent No.: US 7,285,522 B2
(45) Date of Patent: Oct. 23, 2007

(54) BLEACHING WITH IMPROVED WHITENING

(75) Inventor: Gregory van Buskirk, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 156 days.

(21) Appl. No.: 10/927,436

(22) Filed: Aug. 25, 2004

(65) Prior Publication Data

US 2006/0046946 A1 Mar. 2, 2006

(51) Int. Cl.

| | |
|---|---|
| ***C11D 3/02*** | (2006.01) |
| ***C11D 3/20*** | (2006.01) |
| ***C11D 3/395*** | (2006.01) |
| ***C11D 3/42*** | (2006.01) |

(52) U.S. Cl. ..... 510/325; 510/303; 510/326; 510/370; 510/379; 510/380; 510/445; 510/446; 8/108.1

(58) Field of Classification Search ..... None
See application file for complete search history.

(56) References Cited

U.S. PATENT DOCUMENTS

| | | | | |
|---|---|---|---|---|
| 3,706,670 | A | 12/1972 | Gray | |
| 4,028,263 | A | 6/1977 | Gray | |
| 4,116,878 | A | 9/1978 | Deutscher et al. | |
| 4,123,376 | A | 10/1978 | Gray | |
| 4,235,599 | A * | 11/1980 | Davis et al. | 8/108.1 |
| 4,300,897 | A | 11/1981 | Gray | |
| 4,338,210 | A | 7/1982 | Clements et al. | |
| 4,382,799 | A * | 5/1983 | Davis et al. | 8/107 |
| 4,536,389 | A | 8/1985 | White et al. | |
| 4,600,406 | A * | 7/1986 | Corte | 8/108.1 |
| 4,713,079 | A | 12/1987 | Chun et al. | |
| 4,728,453 | A | 3/1988 | Choy | |
| 4,776,972 | A | 10/1988 | Barrett | |
| 5,817,337 | A | 10/1998 | DeSenna | |
| 6,015,782 | A | 1/2000 | Petri et al. | |
| 6,037,318 | A * | 3/2000 | Na et al. | 510/379 |
| 6,099,861 | A | 8/2000 | DeSenna et al. | |
| 6,165,505 | A | 12/2000 | DeSenna et al. | |
| 6,270,722 | B1 | 8/2001 | Yang et al. | |
| 6,413,925 | B2 | 7/2002 | Akbarian et al. | |
| 2003/0104965 | A1 | 6/2003 | Czuczak et al. | |
| 2004/0060122 | A1 | 4/2004 | Batchelor | |
| 2004/0192571 | A1 * | 9/2004 | Briatore et al. | 510/302 |

FOREIGN PATENT DOCUMENTS

| | | |
|---|---|---|
| EP | 0 168 253 B1 | 1/1986 |
| EP | 0 186 234 A2 | 7/1986 |
| EP | 0 395 186 A2 | 10/1990 |

OTHER PUBLICATIONS

M. Zabradnik, "The Production and Application of Fluorescent Brightening Agents", Published by John Wiley & Sons, New York, New York, USA, 1982. All pages.

* cited by examiner

*Primary Examiner*—Gregory R. Del Cotto
(74) *Attorney, Agent, or Firm*—Michael Petrin

(57) ABSTRACT

The invention provides methods, compositions and kits for increasing the brightness retention of a fabric laundered using a hypohalite-generating bleach by employing an amount of bromide-releasing compound sufficient to provide between 0.1 to about 1.5 moles of bromine ion to mole of available chlorine in a wash liquor to mitigate the negative effects of said hypohalite bleach on the optical brightener present in either the wash liquor or on said fabric. The invention also applies to fabrics washed using commercial laundry detergents which typically deliver an optical brightener into said wash liquor, said optical brightener generally exhibiting instability in the presence of said hypohalite bleaches. By employing the inventive methods and/or use of the inventive compositions, enhanced protection of the optical brightener is enabled, resulting in increased brightening of the laundered fabrics, determined versus a control as an increase in the Stensby whiteness measure of the fabric by a $\Delta W$ value of greater than about 3.0.

14 Claims, No Drawings

BLEACHING WITH IMPROVED WHITENING

BACKGROUND OF THE INVENTION

1. Field of the Invention

This invention relates generally to methods and compositions for increasing the brightness retention of a fabric laundered using a hypohalite-generating bleach by employing an amount of bromide-releasing compound sufficient to provide between 0.1 to about 1.5 moles of bromide ion per mole of available chlorine in a wash liquor to mitigate the negative effects of said hypohalite bleach on the optical brightener present in either the wash liquor or on said fabric. The invention also relates generally to fabrics washed using commercial laundry detergents, which typically deliver hypohalite bleach sensitive or unstable optical brighteners. By employing the inventive methods and/or use of the inventive compositions, enhanced protection of the optical brightener is enabled, resulting in increased brightening of the laundered fabrics, measured versus a control as an increase in the Stensby whiteness measure of the fabric by a AW value of greater than about 3.0 versus a control.

2. Description of the Related Art

It is desirable to employ a hypohalite bleach when laundering fabrics in order to bleach stubborn stains, soils and dirt, and to further achieve whitening and brightening of fabrics, particularly of white and light colored textiles and materials, and most particularly of cotton and other natural fiber containing textiles and fabric articles made therefrom. While "whitening" and "brightening" are used somewhat interchangeably to denote overall improved whiteness of a washed fabric, it is generally understood that there are two contributions to the overall improved whiteness effect. Conventionally, whitening may be considered to be the result of removal via detergency and bleaching of colored species, such as stains, pigments, dyes and such from the fabric during a washing and/or bleaching process, while brightening may be considered to be the result of deposition onto the fabric of an optical brightener. Optical brightener deposited onto the fabric results in a perceived enhancement of overall whiteness owing to their inherent properties of generally absorbing ultraviolet wavelengths of incident light (and hence are colorless to the human eye from an absorptive contribution) and emitting longer wavelength light via a fluorescence mechanism. This fluorescence emission, typically at lower energies and hence at visible bluish to reddish wavelengths, effectively contributes a bluish to reddish colored tint to the incident light that is reflected from the fabric surface under illumination, which is then perceived by the human eye and hence the fabric surface is perceptually seen as being a "whiter" white. Since cotton and other fabrics tend to have a slightly yellow or grayish cast, particularly with age and wear of their respective fibers, the use of optical brighteners that deposit onto their surfaces during the wash process can significantly mask this discoloration and provide a pleasing overall white appearance to such treated fabrics.

Use of strong oxidizers such as hypohalites, however, generally result in destruction or oxidation of the optical brightener to a non-functional or tinted derivative that prevents the brightening contribution otherwise provided during laundering, particularly when using commercial laundry detergents that have optical brighteners present that are not stable in the presence of bleach. Attempts to overcome this negative effect generally include the use of more bleach stable optical brighteners, which however suffer from high cost and yet are not fully bleach stable under typical wash conditions. Another approach includes altering the wash conditions to better protect optical brightener in the wash, such as that in U.S. Pat. No. 6,413,925 to Akbarian, et al., which is hereby incorporated by reference, and which teaches the use of an effective level of alkalinity combined with nitrogen bearing surfactants to maintain the wash pH at a value above around 10.5 and preferably near pH 12 under conditions that serve to mitigate the loss of whitener in the presence of a hypohalite bleach.

Use of high wash water pH to overcome negative impacts on brightener and other detersive components however are problematic when lower pH detergents, particularly liquid detergents which contain lower levels of builders and alkalizing agents, are employed in combination with a hypohalite-generating bleach. Some means of preserving and/or enhancing whitening of fabrics in the presence of these oxidizing bleaches that does not require a large modification of the wash liquor pH or alkalinity level would be desirable. Also desirable is a means of achieving improved whitening when using a commercial laundry detergent in combination with a hypohalite-generating bleach. It is also desirable to bleach fabrics with hypohalite-generating bleaches in order to disinfect them without suffering the loss of overall whiteness of the fabrics.

SUMMARY OF THE INVENTION

In accordance with the above objects and those that will be mentioned and will become apparent below, one embodiment of the present invention is a method of preparing an aqueous bleaching solution with improved textile whitening performance, comprising: (i) addition to an aqueous wash liquor of:. a) a hypohalite-generating compound; b) a bromide-releasing compound; c) optionally, a fluorescent whitening agent; d) optionally, an alkalinity source; wherein said bromide-releasing compound provides between 0.1 to about 1.5 moles of bromide ion per mole of available chlorine in said solution, and wherein said solution increases the measured textile whitening performance versus a control by a AW value of greater than about 3.0

In another embodiment of the present invention is a method of preparing an aqueous bleaching solution with improved textile whitening performance, comprising (i) addition to an aqueous wash liquor of: a) a composition comprising a hypohalite-generating compound; b) a laundry detergent comprising a bromide-releasing compound, a fluorescent whitening agent, optionally, a surfactant, and optionally, an alkalinity source; wherein said bromide-releasing compound provides between 0.1 to about 1.5 moles of bromide ion per mole of available chlorine in said solution, and wherein said solution increases the measured textile whitening performance versus a control by a AW value of greater than about 3.0.

In a further embodiment of the present invention is a method of preparing an aqueous bleaching solution with improved textile whitening performance, comprising (i) addition to an aqueous wash liquor of: a) a hypohalite-generating compound; b) a bromide-releasing compound; c) optionally, a fluorescent whitening agent; d) optionally, an alkalinity source; and (ii) addition of a fabric work to said aqueous wash liquor prior to, concurrent with, or after step (i), wherein said fabric work comprises a cotton containing textile work treated with a fluorescent whitening agent, wherein said bromide-releasing compound provides between 0.1 to about 1.5 moles of bromide ion per mole of available chlorine in said solution, and wherein said solution increases the measured textile whitening performance versus a control by a ΔW value of greater than about 3.0.

In yet another embodiment of the present invention is a composition for preparing an aqueous bleaching solution with improved textile whitening performance, comprising: a) a hypohalite-generating compound; b) a bromide-releasing compound; c) optionally, a fluorescent whitening agent; d) optionally, an alkalinity source; wherein said bromide-releasing compound provides between 0.1 to about 1.5 moles of bromide ion per mole of available chlorine in said solution.

In a further embodiment of the present invention is a kit for preparing an aqueous bleaching solution with improved textile whitening performance, comprising: a) a composition comprising a hypohalite-generating compound, and optionally, an alkalinity source; and b) a laundry detergent comprising a bromide-releasing compound, a fluorescent whitening agent, optionally, a surfactant, and optionally, an alkalinity source; c) instructions for combining said composition comprising a hypohalite-generating compound and said laundry detergent to prepare said aqueous bleaching solution, wherein said bromide-releasing compound provides between 0.1 to about 1.5 moles of bromide ion per mole of available chlorine in said solution.

Further features and advantages of the present invention will become apparent to those of ordinary skill in the art in view of the detailed description of the collective embodiments below, when considered together with the attached claims.

DETAILED DESCRIPTION

Before describing the present invention in detail, it is to be understood that this invention is not limited to particularly exemplified systems, compositions or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the total composition.

As used herein, the terms "whitener", "brightener", "fluorescent whitening agent", "optical whitener" and "FWA" are intended to include any fluorescent whitening agents known in the art that act to increase the effective whiteness of fabrics on which they are deposited owing to optical effects relating to their absorbance of incident light and fluorescent emission properties.

The term "available halogen" or "available chlorine", as used herein, is meant to mean and include the amount of active hypohalogen or hypohalite species present in an aqueous solution. By convention, available chlorine ($AvCl_2$) is used to define total measured oxidizing power of a bleach, calculated on the basis of two moles of active (oxidant capable) chlorine per mole of the bleaching species. Alternately by convention, the amount of a bleaching species present may be expressed as the equivalent amount of hypohalogen produced in solution upon dissolution of that bleaching species, generated by either dilution of a salt of a hypohalogen, for example sodium hypochlorite, or dissolution of a hypohalite-generating compound, for example dichloroisocyanurate dissolved in aqueous solution The amount present is generally expressed either as the equivalent weight % (wt %) or parts per million (ppm, 10,000×wt %) of either sodium hypochlorite or sodium hypobromite, or alternatively on a molar basis with respect to the number of moles equivalent to two moles of chlorine atom per mole of available chlorine ($AvCl_2$).

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

The term "laundry detergent", as used herein, is meant to mean and include conventional detergents used to launder textiles in both manual and automatic washing systems, such as for example automatic washing machines. Laundry detergents typically contain ingredients that perform cleaning and whitening, including surfactants, fluorescent whitening agents and other performance adjuncts, such as alkalinity sources, builders, etc., and aesthetic adjuncts, such as dyes and fragrances. Laundry detergents include those detergents in the form of powdered, granular, tablet, gel, paste, solid and liquid compositions.

Methods of Use

Methods of use of the present invention include all such means whereby an aqueous bleaching solution may be prepared so as to provide improved textile whitening performance by addition to an aqueous wash liquor of a hypohalite-generating compound, a bromide-releasing compound, optionally, a fluorescent whitening agent and optionally, an alkalinity source, where the amount of said bromide-releasing compound is sufficient with respect to the amount of available chlorine generated by the hypohalite-generating compound so as to provide between about 0.1 to about 1.5 moles of bromide ion per mole of available chlorine in the aqueous bleaching solution and providing a measured textile whitening performance versus a control by a delta W (ΔW) value greater than about 3.0. The control is a textile treated and measured in an otherwise identical manner to the experimental methods employed as described herein, but not using the compositions or methods of the present invention.

In one embodiment of the present invention, the fluorescent whitening agent is optionally present in the aqueous bleaching solution since existing brightener that is present or has been previously deposited onto the treated textile itself is also preserved under the methods of the present invention so as to exhibit improved whitening performance. Without being bound by theory, it is known that previously deposited brightener present on a textile surface is somewhat less susceptible to the detrimental effects of a hypohalite bleach, likely owing to its more stably bound form and close association with the textile compared to dissolved brighteners present in the aqueous wash liquor that have not yet deposited onto the textiles. However, even the more stable deposited brighteners present on the textile surfaces show some susceptibility to loss owing to hypohalite bleaching and will degrade, resulting in decreased whiteness of bleached fabrics, particularly after one or more washings.

In another embodiment of the present inventive method, a fluorescent whitening agent is present in the aqueous bleaching solution in addition to a hypohalite-generating compound and a bromide-releasing compound. In one embodiment of this preceding inventive method, the fluorescent whitening agent is introduced simultaneously into the bleaching solution employing an inventive composition comprising the said three ingredients. In another embodiment of this preceding inventive method, the fluorescent whitening agent is introduced into an aqueous wash liquor via introduction of a laundry detergent that contains the fluorescent whitening agent, and either simultaneously or subsequently, the inventive compositions comprising a hypohalite-generating compound and a bromide-releasing compound are introduced to said wash liquor to form an aqueous bleaching solution that provides the increased measure textile whitening performance.

In a further embodiment of the present invention, the inventive method is achieved by addition of a composition comprising the hypohalite-generating compound and bromide-releasing compound, optionally, a fluorescent whitening agent, and optionally, an alkalinity source; said composition in the physical form of a tablet, powder, granular or solid composition added to an aqueous wash liquor containing the textiles to be treated to achieve improved whitening performance. In an alternative embodiment of this method, the aqueous wash liquor additionally comprises a laundry detergent, which contains a fluorescent whitening agent, optionally a surfactant, optionally an alkalinity source, and optionally other performance adjuncts known in the art.

In yet another embodiment of the present inventive method, a kit is employed with instructions for preparing an aqueous bleaching solution by combining a composition comprising a hypohalite-generating compound, optionally an alkalinity source, and a laundry detergent comprising a bromide-releasing compound, a fluorescent whitening agent, optionally, a surfactant, and optionally an alkalinity source combined so as to provide between 0.1 to about 1.5 moles of bromide ion per mole of available chlorine in the aqueous bleaching solution. In an alternative embodiment of this preceding inventive method, an aqueous solution of a hypohalite bleach is combined with a laundry detergent comprising a bromide-releasing compound to form an aqueous bleaching solution having between 0.1 to about 1.5 moles of bromide ion per mole of available chlorine.

In yet another embodiment of the present inventive method, a sodium hypochlorite bleach containing an alkalinity source is added to an aqueous wash liquor containing a laundry detergent comprising a bromide-releasing compound in sufficient quantity so as to provide an aqueous bleaching solution with between 0.1 to about 1.5 moles of bromide per mole of available chlorine.

Composition

Compositions of the present invention may contain one or more hypohalite-generating compounds, one or more bromide-releasing compounds, optionally a fluorescent whitening agent, optionally an alkalinity source, and optionally other cleaning and performance adjuncts, including, but not limited to surfactants, builders, pH control agents, chelants, sequestrants, fillers, binding agents, anti-dusting agents, dispersing agents, co-surfactants, and the like, and additionally aesthetic adjuncts, including, but not limited to fragrances, coloring agents, dyes, pigments and the like which contribute to the aesthetic appeal of the compositions.

Hypohalite-Generating Compound

A hypohalite-generating compound or halogen bleach source is a principal ingredient. This oxidant chemical provides good stain and soil removal and is additionally a broad-spectrum antimicrobial agent. Suitable compounds for providing the available halogen concentration are hypochlorite-generating compounds or hypobromite-generating compounds. These compounds must be at least partially or fully water-soluble and generate an active halogen ion (i.e., hypohalite including the species $OCl^-$ and/or $OBr^-$) upon dissolution in water. The hypohalite bleach source may be selected from various hypohalite-producing species, for example, bleaches selected from the group consisting of the alkali metal and alkaline earth metal salts of hypohalite, haloamines, haloimines, haloimides, haloamides, and mixtures thereof. All of these are believed to produce hypohalous bleaching species in situ, that is, when dissolved into aqueous solution. Hypochlorite and compounds producing hypochlorite in aqueous solution may be employed in the inventive compositions and methods of the present invention, although hypobromite and hypobromite generating compounds may also be employed. Additional representative hypochlorite-producing compounds include sodium, potassium, lithium, calcium and magnesium hypochlorite, chlorinated trisodium phosphate, chlorinated trisodium polyphosphate, chlorinated trisodium phosphate dodecahydrate, and mixtures thereof. These aforementioned hypohalite-generating compounds are suitably employed in solid, powdered, granular, paste and tablet forms owing to their stability in essential dry form and good mechanical processability. In aqueous liquid compositions the alkali metal hypochlorites, namely, sodium, potassium and lithium hypochlorite, and mixtures thereof are suitably employed as a hypohalite source.

In this present invention, it is possible to use an alkali metal hypochlorite bleach which has a relatively low salt content. For example, hypochlorite bleaches are commonly formed by bubbling chlorine gas through liquid sodium hydroxide or. corresponding metal hydroxide to result in formation of the corresponding hypochlorite, along with the co-formation of a salt such as sodium chloride. In other contexts, it has been found desirable to use hypochlorites formed for example by reaction of hypochlorous acid with alkali metal hydroxide in order to produce the corresponding hypochlorite with water as the only substantial by-product. Hypochlorite bleach produced in this manner is referred to as "high purity, high strength" bleach ,or also, as "low salt, high purity" bleach, and is available from a number of sources, for example Olin Corporation which produces hypochlorite bleach as a 30% solution in water. The resulting solution could then diluted to produce the hypochlorite strength suitable for use in the present invention.

The hypohalite may be formed with other alkaline metals as are well known to those skilled in the art. The hypohalite and any salt present within the composition, including the bromide-releasing compounds of the present invention, can also serve as a source of ionic strength for the composition.

Also suitable are hypochlorite-generating organic compounds including chlorinated isocyanuric acid compounds such as trichlorocyanuric acid, dichlorocyanuric acid, sodium dichloroisocyanurate and potassium dichloroisocyanurate. Also suitable are other hypochlorite-generating compounds including, but not limited to, N,N'-dichloro-s-trizinetrione, N-chlorophthalamide, N-dichloro-p-toluene sulphonamide, 2,5-N,N'-dichloroazodicarbonamidine hydrochloride, N,N,N,N-tetrachloroglycoluracil, N,N-dichlorodichloroyl, N,N,N-trichloromelamine, N-chlorosuccinimide, methylene-bis(1-chloro-5,5-dimethylhydantoin), 1,3-dichloro-5-methyl-5-isobutylhydantoin, 1,3-dichloro-5-methyl-5-n-amylhydantoin, 1,3-dichloro-5,5-dimethylhydantoin, 1,4-dichloro-5,5-dimetbylhydantoin, 1,3-dichloro-5,5-diethylhydantoin, 1,4-dichloro-5,5-diethylhydantoin, 1-1-monochloro-5,5-dimethylhydantoin, sodium-para-toluenesulfochloramine, dichlorosuccinamide, 1,3,4,6-tetrachloroglycoluril, potassium and sodium salts of chloroisocyanuric, dichlorocyanuric and trichlorocyanuric acid, potassium and sodium salts of N-brominated and N-chlorinated succinimide, malonimide, phthalimide and naphthalimide, and mixtures thereof. Also potentially suitable are hydantoins, such as dibromo- and dichloro-dimethylhydantoin, chlorobromo-dimethylhydantoin, N-chlorosulfamide (haloamide), chloramine (haloamine) and mixtures thereof.

Suitable hypobromite-generating organic compounds include brominated isocyanuric acid compounds such as tribromocyanuric acid, dibromocyanuric acid, sodium dibromoisocyanurate, potassium dibromoisocyanurate, N-bromophthalamide, N,N'-dibromodimethylhydantoin, N,N'-dibromodiethylhydantoin, N,N'-dibromodimethylglycoluracil, dibromotriethylenediamine dihydrochloride, and mixtures thereof. Also suitable are partially chlorinated and brominated compounds, including monobromodichlorocyanuric acid and its salts, bromochlorocyanuric acid and its salts, N-bromo-N'-chlorodimethylhydantoin, N-bromo-N'-chlorodiethylhydantoin, N-bromo-N'-chlorodiphenylhydantoin, N-bromo-N,N-dichlorodimethylglycoluracil, N-bromo-N-chlorosodium cyanurate, bromochlorotriethylenediamine dihydrochloride, bromochloromethyletbylhydantoin and mixtures thereof. These aforementioned organic hypochlorite and hypobromite generating compounds are typically employed in the inventive compositions in solid, powdered, granular, paste and tablet forms owing to their stability in essential dry form and good mechanical processability.

All of these materials are believed to produce hypohalous bleaching species in situ. Sufficient amounts of the available halogen compound are incorporated in the mixture to provide, upon suitable dispersion, dissolution or dilution into an aqueous wash liquor, an initial available halogen concentration in the aqueous bleaching solution of between about I ppm to about 12,000 ppm. Generally, levels of between about 150 to 300 ppm in an aqueous bleaching solution are found sufficient to provide antimicrobial activity and disinfection under typical laundry load and soil conditions during laundering of textiles.

Bromide Releasing Compound

The bromide-releasing compound or bromide source used in the present invention is a solid or water soluble bromide which provides a ready source of bromide ions on dissolution or dilution into water. Suitable bromide sources include alkali metal and alkaline earth metal bromide salts, such as lithium bromide, sodium bromide, sodium bromide dihydrate, potassium bromide, magnesium bromide, calcium bromide, and the like, including mixtures thereof. Also suitable are bromide sources in which the bromide ion is a salt of a suitable organic cation, such as for example, but not limited to ammonium bromide, alkylammonium bromide, dialkylammonium bromide, trialkylammonium bromide, wherein said alkyl radicals are independently selected from straight or branched aliphatic, aromatic or aryl hydrocarbon radicals of between 1 to about 24 carbon atoms. Also suitable as a bromide-releasing compound are bromide ion exchange materials, that is materials able to exchange a bromide ion in the presence of the more common chloride ion in aqueous solution, and which are typically water insoluble polymeric and mineral matrixes preloaded with high bromine ion content.

Sufficient amounts of the bromide-releasing compound are used in the present invention, so as to provide between 0.1 to about 1.5 moles of bromide ion per mole of available chlorine when the hypohalite-generating compound and bromide-releasing compound are combined in an aqueous bleaching solution. Generally, improved whitening is seen to increase with increasing mole ratio of the bromide ion to available chlorine. Depending on the form of each compound, dissolution rates and the manner in which the inventive method is carried out, however, the effective molar ratios may vary over time in the aqueous bleaching solution, such that the mole ratio changes during dissolution and over time as the available chlorine content in the bleaching solution decreases owing to oxidant loss. Hence, the molar ratios are generally calculated on a theoretical 100% yield basis (that is 100% of the available bromide and available chlorine on a mole basis) with respect to the materials used and with respect to the initial bleaching solution conditions.

Fluorescent Whitening Agent

Any fluorescent whitening agent, optical brightener or other brightening or whitening agents known in the art can be incorporated at levels typically from about 0.05% to about 2%, by weight, into the treating compositions of the present invention as described herein. Mixtures and combinations of any suitable fluorescent whitening agents are also possible, particularly for treating collected fabrics of various fiber types, such as cotton, cellulosic and synthetic fibers. Commercial optical brighteners, which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zabradnik, Published by John Wiley & Sons, New York (1982), which is hereby incorporated by reference.

Additional non-limiting examples include the distyrylbiphenyl (DSBP) optical brighteners which can be mono- or polysulfonated, triazinyl stilbene optical brighteners which can be mono- or polysulfonated, triazolylstilbenes optical brighteners which can be mono- or polysulfonated, naphthotriazolyl stilbenes optical brighteners which can be mono- or polysulfonated, diarylpyrazolines, and coumarins as described in U.S. patent application No. 2003/0126689, which is hereby incorporated by reference. Among the whitening agents suitable for use within the scope of this invention are the fluorescent whitening agents disclosed in U.S. Pat. Nos. 4,294,711, 5,225,100, 4,298,490, 4,309,316, 4,411,803, 4,142,044, and 4,478,598, all incorporated herein by reference. Additionally, whitening agents may be selected from those fluorescent whitening agents consisting of diaminostilbene disulfonic acids and diaminostilbene sulfonic acid-cyanuric chlorides, and mixtures thereof.

Suitable fluorescent whitening agents include, but are not limited to the following classes of compounds: carbocycles (e.g. distyrylbiphenyl, distyrylbenzene, divinylstilbene), furans, benzofurans (e.g., bis(benzo[b]furan-2- ylbiphenyls), 1,3-diphenyl-2-pyrazolines, coumarins, naphthalimides; carbostyril compounds; 1,3-diphenyl-2-pyrazolines; benzadyl substitution products of ethylene, phenylethylene, stilbene, thiophene; and combined hetero-aromatics. Among fluorescent whitening agents which may be used are also the sulfonic acid salts of diaminostilbene derivatives such as taught in U.S. Pat. No. 2,784,220 to Spiegler or U.S. Pat. No.2,612,510 to Wilson et al., both of which are hereby incorporated by reference.

Also suitable are fluorescent whitening agents selected from the stilbenic type: 4,4'-bis anilino-6-[bis(hydroxyethylmethyl)amino]-s-triazin-2-yl amino 2,2'-stilbenedisulfonic acid, available as Tinopal® 5BM-GX from Ciba-Geigy; 4,4'-bis anilino-6 [bis(2,2-hydroxyethyl)amino]-2-triazin-2,2-yl amino-2,2'stilbene disulfonic acid, available as Tinopal® UNPA-GX from Ciba-Geigy), cyanuric chloride/diaminostilbene types such as Tinopal AMS, DMS, 5BM, and UNPA from Ciba-Geigy Corp. and Blankophor DML from Mobay and the distyrylbiphenyl types (e.g. 2,2'-biphenyl-4,4'-diyl-di-2,1-ethenediyl benzenesulfonic acid, disodium salt, available as Tinopal® CBS-X from Ciba-Geigy).

Fabric Works

The present invention also relates to the use of the inventive methods and compositions in combination with a fabric work. The fabric work includes those textiles, fabrics and related articles, for example, but not limited to clothing, towels, upholstery and all such related constructs of textile fibers, that are treated with, and/or treatable with a fluorescent whitening agent.

Generally, the textiles comprising fabric works are liberally treated with fluorescent whitening agents during processing to improve the appearance of whiteness and/or brightness of both white and colored textiles. Whiteners, dyes and pigments incorporated into the melt phase of the synthetic fiber materials (nylon, polyester, polyamide, etc) are generally unaffected by oxidative exposure (light, oxygen and halogen releasing bleaches). However, fabric works composed of cotton or cellulosic materials in part or in whole generally employ fluorescent whiteners that are subject to oxidative damage, e.g., from halogen-releasing bleaches. The fluorescent whitening agents used on cotton or cellulosic materials are generally similar to those used in commercial detergents and are subject to degradation from ageing, wear, oxidative degradation and the like. Those, the compositions and methods of the present invention are suitably employed in a wash liquor for the purpose of preserving these agents already present on the fabric works during the bleaching process, and further preserving additional optional fluorescent whitening agents also present in the bleaching solution to enable their further deposition onto the fabric work to provide improved whitening during the bleaching process.

It has surprising been found that use of the current inventive compositions and methods during a bleaching process involving these fabric works also results in improved preservation of the overall whiteness of cotton and cellulosic textiles, even in the absence of any additional fluorescent whitening agent present in the bleaching solution. Without being bound by theory, it is believed that the application of the inventive methods described herein, also serve to protect fluorescent whitening agents when they are bound to a fabric work by a similar mechanism as proposed for such protection of these agents in solution form, that is to say via formation of brominated fluorescent whitening agent derivatives that resist oxidative destruction and preserve their fluorescent whitening efficacy.

Alkalinity Source

The inventive composition may optionally include an alkalinity source, which is believed to increase the effectiveness of the surfactant and overall cleaning efficiency of the compositions. The alkalinity source may be a builder, a buffer and/or a pH-adjusting agent, which can also function as a water softener and/or a sequestering agent in the inventive composition. The builder, buffer and pH adjusting agents may be used alone, or in mixtures, or in combination with or in the form of their appropriate conjugate acids and/or conjugate bases, for adjusting and controlling the pH of the inventive compositions.

A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives. Builders or buffers can also include polyacetates and polycarboxylates. The polyacetate and polycarboxylate compounds include, but are not limited to, sodium, potassium, lithium, ammoniun, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth metal salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Suitable buffering agents for compositions of this invention are nitrogen-containing materials. Some examples are amino acids such as lysine or lower alcohol amines like monoalkanolamine, dialkanolamine and trialkanolamine. Examples of suitable alkanolamines include the mono-, di-, and triethanolamines. Other suitable nitrogen-containing buffering agents are tri(hydroxymethyl) amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbamate, citric acid, and acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other suitable pH-adjusting agents include sodium or potassium hydroxide.

When an alkalinity source is employed in the inventive compositions, it is generally used at a level sufficient to increase the pH of the aqueous bleaching solution to a value greater than or around at least about pH 7. When the inventive compositions are employed in a method combining them with built laundry detergents, that is to say laundry detergents having an alkalinity source of their own sufficient to raise the wash liquor pH value to a level of greater than or around at least about pH 7, the use of a second alkalinity source remains optional, or lower amounts of an alkalinity source may be employed. It is believed that the alkalinity source mainly serves to increase the effective cleaning of stains and soils, and thereby increases the effectiveness of the overall cleaning and bleaching effect.

Optional Adjuncts

Other optional adjuncts, including an alkalinity source and other common ingredients known in the art and commonly used in laundry detergents may be employed in the inventive compositions.

Physical Forms

Compositions and methods of use of the present invention may employ the materials and the optional additives and adjuncts in a variety of physical forms, including in the form of liquid formulations, including aqueous solutions and non-aqueous based liquid dispersions of the inventive compositions. Aqueous solutions typically comprise mostly water and water-soluble materials, although suspensions of less soluble materials in water may also be employed. Non-aqueous liquids can also be employed, including liquid materials that are generally free pouring at ambient conditions and which include, but are not limited to solvents, nonionic surfactants, liquid silicones, hydrocarbons and the like. Substantially solid forms may also be employed and generally include compositions in essentially dry form, including for example in the form of a granule, tablet, mull, cake, paste, and combinations thereof.

Solid Compositions

When compositions of the present invention are embodied in solid physical forms, for example in a granule or tablet form in which the various components are mixed and formed in substantially intimate contact, in is desirable to ensure that either the reactive ingredients (particularly the hypohalite-generating compounds) are optionally encapsulated and/or the amount of water and/or exposure to water and moisture is minimized to insure stability of the inventive compositions over prolonged storage times and environmental conditions that formulated products often experience. Minimizing water to some extent is generally preferred in solid physical forms even if the optionally encapsulated materials are employed. Generally, reducing the amount of extraneous water (i.e. free water or moisture as opposed to stable hydrates of compositional ingredients) to below about. 1-5 wt % is sufficient for good stability with most dry hypohalite-generating compounds. Appropriate water and moisture resistant packaging may also be employed for storing the inventive compositions, including for example, but not limited to, storage within plastic pouches, polymer films, impermeable glass, plastic and polymeric containers, and moisture resistant paper, wax- or polymer film-coated cardstock and cardboard containers.

It may also be desirable to employ encapsulated components, whereby the reactive or sensitive components of the inventive composition are substantially coated with a water soluble, but effectively moisture impermeable barrier that remains intact under storage conditions but dissolves or breaches during water immersion so as to enable the coated component to then disperse or dissolve in water. In one embodiment, the hypohalite-generating compound may be encapsulated. In another embodiment, the fluorescent whitening agent, fragrance, dye or other sensitive ingredient may be encapsulated. Many of the hypohalite-generating compounds useful herein are also commercially available in a coated form, or may readily be coated using a encapsulating material such as a silicone, hydrocarbon, wax or flow aid to reduce water permeation. Examples of suitable encapsulating materials (i.e. protective coating) include, but are not limited to, soluble silicates, powdered silicas and hydrophobic silicas, sodium and calcium salts of oleic acid, stearic acid and the like, fatty materials, waxes, silicones, silicone waxes, and non-ionic surfactants normally solid at room temperature.

The protective coating for the sensitive ingredients may be formed using conventional coating, encapsulation and/or coacervation techniques known to those skilled in the art or described in the pertinent literature. For example, the coating may be applied by spraying a solution or emulsion of the encapsulating material into the air inlet stream of a fluidized bed comprising the fragrance or colorant particles to be encapsulated. Other techniques, of course, may be used.

The solid compositional embodiments of the invention may be formed using a granulation, tabletting and/or extrusion process. In a granulation or tabletting process, the raw materials or ingredients are combined and a binding aid included that provides sufficient binding capability to allow stable granules to be formed, generally with a minimum of physical mixing. In a tabletting process the mixed ingredients and an optional binding aid, optionally including a lubricant, are further compressed within a form or die under sufficient pressure to form a tablet of sufficient density that can be handled and packaged without syneresis or breakage, but which retains favorable dissolution properties in aqueous liquors under typical usage conditions. After the tabletting process, the tablet compositions are allowed to dry, if needed.

Alternately, an extrusion process can be employed wherein the ingredients are combined, mixed and extruded under pressure through a die to form a substantially longitudinal noodle of any desired cross-sectional configuration (i.e. circular, ellipsoid, planar or polymorphic), followed by cutting said noodle into desired lengths to form the correspondingly shaped final product. For example a circular noodle cut at any desired length to form a cylindrical shaped solid. After extrusion and cutting to the desired length or shape, the extruded compositions are allowed to dry, if needed.

The initial mixing step may involve combining all components simultaneously, or it may involve separately mixing the dry components, and the liquid components; alternatively, the various components may, simply, be added one at a time. The mixture is then introduced into an extruder at a suitable rate (as a blend of the dry and liquid mixtures, or with the dry and liquid mixtures fed separately), wherein temperatures are maintained within a suitable range, typically between approximately 30° F. to 120° F. The product is extruded using a suitable pressure, typically in the range of approximately 20 to 1000 psi.

Liquid Compositions

In non-aqueous liquid embodiments of the present invention, the non-aqueous liquids that may be employed include liquid materials that are generally free pouring at ambient conditions, that is having sufficient viscosity to hold dry ingredients in suspended form, although higher viscosities sufficient to form a gel are also suitable when other delivery means than pouring are employed to dispense the inventive compositions. In the absence of any significant level of water or moisture, generally at levels of around 5% water or below, the dry ingredients may simply be mixed and/or suspended into the non-aqueous liquids of suitable viscosity, generally including viscosities of greater than about 100 centipoise. Suitable liquids include, but are not limited to solvents, nonionic surfactants, liquid silicones, hydrocarbons and the like.

When aqueous liquid embodiments of the present invention are desired, it is generally required that the hypohalite-generating compound is formulated separately from the bromide-releasing compound and/or fluorescent whitening agent. In one embodiment of the inventive method, dual liquid aqueous compositions, one composition comprising the hypohalite-generating compound in one aqueous part, and a second composition comprising the bromide-releasing compound and fluorescent whitening agent combined in a separate second aqueous part are packaged in a dual container system, and combined at time of use to form the bleaching solution of the present invention. In this preceding embodiment, examples of suitable dual container systems include, but are not limited to, a bottle having two separated chambers, a pouch having two separated liquid compartments, and a kit employing two separate bottles each separately containing one part each of the two said aqueous compositions, which are suitably combined at the time of use to prepare the bleaching solution of the present invention.

Experimental

In the following section, experiments were run to demonstrate the surprisingly improved and retained brightness of the fabric work washed according to the inventive method and employing the inventive compositions. The fabric work can be preferably selected from cotton-containing fabrics, such as cotton, polycotton; and mixed polyester fabrics. The fabrics are washed in standard U.S. automatic washing machines, such as those manufactured by Whirlpool Corporation, Benton Harbor, Mich., Maytag Corporation, Newton, Iowa, and other manufacturers. These machines typically have about a 69 liter (L) capacity when filled. Although the standard washing machine is top loading, a rather recent development, spearheaded by European manufacturers, such as Miele, is the front loading machine, which uses less water per washload. For purposes of testing, 100% cotton flags were employed as test materials for evaluation, included with about six pounds of 50% cotton/50% polyester pillowcases as ballast to represent a typical wash environment and amount of fabric work typically loaded into a washing machine.

In the experiments, standard commercial laundry detergents were used. These included Liquid Tide® (Procter & Gamble). These formulations were added in amounts such as to add about 0.5-2 grams/liter (g/L) of detergent per washload, as per package instructions. Although it is not certain, it is believed that the brighteners present in these commercial laundry detergents are standard compounds such as stilbene or styrylbiphenyl derivatives, and settle out or deposit onto fabrics during the washing cycle. See also, Mitchell et al., U.S. Pat. No. 4,900,468, column 5, line 66 to column 6, line 27, incorporated herein by reference.

The machines typically have a fill/wash cycle of about 12 minutes (the initial volume of water to which the laundry detergent, additives and fabric are introduced during this cycle), a rinse cycle of about 2 minutes, and a spin cycle of about 10 minutes. Between the wash, rinse and spin cycles the introduced water is drained. These "interim" cycles are to be distinguished from the wash cycle itself, which encompasses all these steps. For purposes of testing, all detergents and additives were introduced within the first minute of the fill cycle so that agitation would disperse or dissolve them completely, followed by introduction of the fabric, i.e. pillowcase ballast.

In the experiments, a baseline is established by "reading", with a Gardner calorimeter, a 100% cotton white swatch before and after washing, in one cycle, with a standard hypochlorite bleach product (containing no surfactants or hydrotropes). The data are then calculated and compared according to the Stensby equation, $$\Delta W=(L_w+3a_w-3b_w)-(L_s+3a_s-3b_s)$$

using the instrumentally determined color component contributions (L, a and b) measured prior to (s) and subsequent to (w) the indicated treatment. The resulting measure is thus simplified as the difference between final brightness and initial brightness and expressed as ΔW. In the following Table 1, results of a series of wash experiments on fabric works using the detergent combined with a hypochlorite bleach and inventive compositions are compared. Also measured were stain removal values obtained on twelve various common vegetable, juice, oil, soil and-pigment stains applied to a 100% cotton test flag to determine the effects of the treatments and the inventive composition treatments on stain removal, measured in a similar fashion but compared according to the ΔLab equation, $$\Delta Lab=\sqrt{[(L_w+3a_w-3b_w)^2-(L_s+3a_s-3b_s)^2]}$$

using an unstained cotton swatch as a reference combined with before and after individual stain readings, so that calculated values reflect a percent stain removal value (% SR) wherein 100% then corresponds to complete stain removal.

TABLE 1

| Treatment No. | Detergent (1) | Additive (2) | Available Chlorine (2) (ppm) | Second Additive (3) | % SR (4) | Delta W (5) |
|---|---|---|---|---|---|---|
| 1 Control (6) | Liquid Tide | — | 0 | — | 74.08 | 3.14 |
| 2 | Liquid Tide | 1 tablet | 33 | — | 70.25 | 2.77 |
| 3 | Liquid Tide | 1 tablet | 33 | 0.5 moles $Br^-$ | 75.02 | 3.22 |
| 4 | Liquid Tide | 1 tablet | 33 | 1.0 moles $Br^-$ | 76.14 | 3.05 |
| 5 Control | Liquid Tide | 2 tablets | 66 | — | 78.85 | 2.53 |
| 6 | Liquid Tide | 2 tablets | 66 | 0.5 moles $Br^-$ | 86.23 | 3.31 |
| 7 | Liquid Tide | 2 tablets | 66 | 1.0 moles $Br^-$ | 86.27 | 3.84 |

(1) Liquid Tide ®, a product of the Procter & Gamble Company, USA.
(2) Carbona Chlorine Bleach Tabs, a product of Delta Carbona, L.P. Germany. Normal usage is one tablet per washload. Two tablets per washload recommended for heavily soiled or large loads. Available chlorine as ppm $AvCl_2$.
(3) Potassium bromide salt added to aqueous wash liquor simultaneously with chlorine bleach tablet in weight amount sufficient to provide the indicated number of mole equivalents of bromine ion ($Br^-$) to mole of available chlorine present based on 100% theoretical yield equivalent to complete dissolution of chlorine bleach tablet.
(4) Average percent stain removal of twelve common stains.
(5) Stensby ΔW determined as per test method.
(6) All treatment conditions identical except for presence of indicated additives.

Results in Table 1 show that use of a hypohalite bleach at a typical recommended dosage level (Treatment No. 2, one tablet) in conjunction with a commercial laundry detergent results in significant loss of whiteness (ΔW) as measured versus results obtained using the laundry detergent alone (Treatment No. 1). Use of the hypohalite bleach at a higher level (Treatment No. 5, two tablets) results in even greater loss of whiteness. It should be noted that these differences are also readily apparent by eye when two test swatches are examined in a side-by-side comparison under ambient room lighting conditions. Overall stain removal is generally observed to be improved with the presence of the hypohalite bleach if used at a higher level, but recommended lower dosage levels actually result in somewhat lower stain removal performance across the twelve-stain set. However, at higher hypohalite bleach levels, the oxidizing power of the bleach produces irmproved stain removal of the oxidant sensitive stains within the twelve stain set resulting in overall improvement of the stain removal average.

When the methods and compositions of the present invention are employed, a dramatic improvement in the whiteness (ΔW) is achieved. By use of a 0.5 mole ratio of bromine ion to available chlorine, the measured whiteness from treatments using both a normal (Inventive Treatment No. 3) and high (Inventive Treatment No. 6) dosage level of the hypohalite bleach is seen to increase significantly, even exceeding that of the laundry detergent only (control). At a higher mole ratio of bromine ion to available chlorine (Inventive Treatment No. 4 with 1.0:1 ratio) the measured whiteness is essentially retained at lower levels of the bleach. Surprisingly, at the higher mole ratio (1.0) the measured whiteness is increased even when higher levels (Inventive Treatment No. 7) of the hypohalite bleach is employed. Without being bound by theory, it is believed that the presence of the bromine ion serves to mitigate the otherwise negative effects of the hypohalite bleach on the whitener, either by partitioning of the hypohalite via in situ reaction to the less aggressive hypobromite vs. hypochlorite oxidizing species, or by bromination of the whiteners at susceptible molecular sites which owing to the slower heavy atom kinetics of bromine vs. chlorine are preferentially stabilized through formation of a brominated derivative of the fluorescent whitening agents.

TABLE 2

| Ingredient (1) | Ex. 1 | Ex. 2 | Ex. 3 | Ex. 4 | Ex. 5 | Ex. 6 |
|---|---|---|---|---|---|---|
| Sodium Dichloro-s-Triazinetrione (2) | 40.0 | | | | 20.0 | |
| Sodium trichloro-isocyanurate (3) | | 40.0 | | | | 20.0 |
| Dichlorodimethylhydantoin (4) | | | 40.0 | | | |
| Calcium hypochlorite (5) | | | | 40.0 | 20.0 | 20.0 |
| Sodium Bicarbonate | 36.0 | 30.0 | 30.0 | 30.0 | 30.5 | 20.5 |
| Sodium Carbonate | | | | 5.0 | 5.0 | 5.0 |
| Boric Acid | 17.0 | 17.0 | 17.0 | 17.0 | 14.0 | 14.0 |
| Microcrystalline Cellulose (6) | 2.0 | 2.0 | 2.0 | 2.0 | | |
| Clay (6) | | | | | 5.0 | 5.0 |
| Potassium Bromide | 5.0 | 10.0 | 10.0 | 5.0 | 5.0 | 10.0 |
| Tinopal AMS (7) | | 1.0 | | | | |
| Tinopal BMX (7) | | | 1.0 | 1.0 | | |
| Tinopal CBS-X (7) | | | | | 0.5 | 0.5 |

(1) Weight % expressed on 100% actives basis excluding moisture content.
(2) Available from Occidental Chemical Co, Dallas, TX
(3) Available from Deyuan Chemical Co., Ltd, Guan County, China
(4) Available as Dantochlor ™ from Lonza Chemical, Fairlawn, NJ.
(5) Available from JCI Jones Chemicals, Sarasota, FL.
(6) Binding aids in finely divided form.
(7) All available from Ciba Specialty Chemicals North America, Tarrytown, NY.

Table 2 presents six examples of suitable embodiments of the present invention mixed and formed into a corresponding tablet that are suitably added to a wash liquor to form bleaching solutions for treating a fabric work.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

I claim:

1. A method of preparing an aqueous bleaching solution with improved textile whitening performance, said method comprising:

(i) addition to an aqueous wash liquor of a solid composition comprising:

a) 10 to about 90 weight % of a hypohalite-generating compound;

b) 1 to about 90 weight % of a bromide-releasing compound;

c) 0.001 to about 10 weight % of a fluorescent whitening agent;

d) optionally, 0.001 to about 50 weight % of an alkalinity source;

wherein said bromide-releasing compound provides between 0.5 to about 1.0 moles of bromide ion per mole of available chlorine in said solution, and wherein said solution increases the measured textile whitening performance versus a control by a ΔW value of greater than about 3.0, wherein said fluorescent whitening agent is not hypohalite bleach stable, wherein the physical form of said solid composition is selected from the group consisting of a granule, tablet, and combinations thereof.

2. The method of claim 1 further comprising: (ii) addition of a fabric work to said aqueous wash liquor prior to, concurrent with, or after step (i), wherein said fabric work comprises a cotton containing textile work optionally treated with a fluorescent whitening agent.

3. The method of claim 1 wherein said aqueous wash liquor comprises an effective level of a commercial laundry detergent dissolved therein.

4. The method of claim 1 wherein said laundry detergent comprises a surfactant, a fluorescent whitening agent, and optionally, an alkalinity source.

5. The method of claim 1 wherein said laundry detergent further comprises a bromide-releasing compound.

6. The method of claim 1 wherein said alkalinity source is present in sufficient amount to increase the pH of said aqueous bleaching solution to a value greater than or about pH 7.

7. A method of preparing an aqueous bleaching solution with improved textile whitening performance, said method comprising:

(i) addition to an aqueous wash liquor of:

a) a solid composition comprising a) 10 to about 90 weight % of a hypohalite-generating compound; b) 1 to about 90 weight % of a bromide-releasing compound; c) 0.001 to about 10 weight % of a fluorescent whitening agent; d) optionally, 0.001 to about 50 weight % of an alkalinity source; wherein said solid composition is selected from the group consisting of a granule, tablet, and combinations thereof; and (ii) addition to said aqueous wash liquor of:

b) a laundry detergent comprising: a bromide-releasing compound, a fluorescent whitening agent, a surfactant, and optionally, an alkalinity source;

wherein said bromide-releasing compound provides between 0.5 to about 1.0 moles of bromide ion per mole of available chlorine in said solution, wherein said solution increases the measured textile whitening performance versus a control by a ΔW value of greater than about 3.0, and wherein said addition (i) and (ii) may be done in any order or simultaneously, wherein said fluorescent whitening agent is not hypohalite bleach stable.

8. The method of claim 1 wherein said hypohalite-generating compound is a hypochlorite-generating compound selected from the group consisting of sodium hypochlorite, potassium hypochlorite, calcium hypochlorite, lithium hypochlorite, magnesium hypochlorite, , chlorinated trisodium phosphate, chlorinated trisodium polyphosphate, chlorinated trisodium phosphate dodecahydrate, chlorinated isocyanuric acids, trichlorocyanuric acid, dichlorocyanuric acid, sodium dichloroisocyanurate, potassium dichloroisocyanurate, N,N'-dichloro-s-trizinetrione, N-chlorophthalamide, N-dichloro-p-toluene sulphonamide, 2,5-N,N'-dichloroazodicarbonamidine hydrochloride, N,N,N,N-tetrachloroglycoluracil, N,N-dichlorodichloroyl, N,N,N-trichloromelamine, N-chlorosuccinimide, methylene-bis(1-chloro-5,5-dimethylhydantoin), 1,3- dichloro-5-methyl-5-isobutylhydantoin, 1,3-dichloro-5-methyl-5-n-amylhydantoin, 1,3-dichloro-5,5-dimethylhydantoin, 1,4-dichloro-5,5-dimetbylhydantoin, 1,3-dichloro-5,5-diethylhydantoin, 1,4-dichloro-5,5-diethylhydantoin, 1-1-monochloro-5,5-dimethylhydantoin, sodium-para-toluenesulfochloramine, dichlorosuccinamide, 1,3,4,6-tetrachloroglycoluril, potassium and sodium salts of chloroisocyanuric, dichlorocyanuric and trichlorocyanuric acid, potassium and sodium salts of N-brominated and N-chlorinated succinimide, malonimide, phthalimide and naphthalimide, halogenated hydantoins, dibromo- and dichloro-dimethylhydantoin, chlorobromo-dimethylhydantoin, N-chlorosulfamide (haloamide), chloramine (haloamine), and mixtures thereof.

9. The method of claim 1 wherein said bromide-releasing compound is selected from the group consisting of alkali metal and alkaline earth metal bromide salts, lithium bromide, sodium bromide, sodium bromide dihydrate, potassium bromide, magnesium bromide, calcium bromide, ammonium bromide, alkylammonium bromide, dialkylammonium bromide, trialkylammonium bromide, wherein said alkyl radicals are independently selected from straight or branched aliphatic, aromatic or aryl hydrocarbon radicals of between 1 to about 24 carbon atoms, bromide-releasing ion exchange materials, and combinations thereof.

10. The method of claim 1 wherein said alkalinity source is selected from the group consisting of the alkali metal and alkaline earth metal salts of: silicate, metasilicate, polysilicate, borate, hydroxide, carbonate, carbamate, phosphate, polyphosphate, pyrophosphates, triphosphates, and tetraphosphates; ammonium hydroxide, monoethanolamine, monopropanolamine, diethanolamine, dipropanolamine, triethanolamine, 2-amino-2-methylpropanol, lysine derivatives, monoalkanolamine, dialkanolamine, trialkanolamine, monoethanolamine, diethanolamine, triethanolamine, tri (hydroxymethyl) amino methane (TRIS), 2-amino-2-ethyl-1,3- propanediol, 2-amino-2-methyl-propanol, 2-amino-2-methyl-1,3-propanol, disodium glutamate, N-methyl diethanolamide, 2-dimethylamino-2- methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl) glycine (bicine), N-tris(hydroxymethyl)methyl glycine (tricine), and mixtures thereof.

11. The method of claim 1 wherein said aqueous bleaching solution increases the measured textile whitening performance versus a control by a ΔW value of greater than about 3.0 within completion of one laundry wash cycle.

12. A method of preparing an aqueous bleaching solution with improved textile whitening performance, said method comprising the steps of:

(i) addition to an aqueous wash liquor of a solid composition comprising:

a) 10 to about 90 weight % hypohalite-generating compound;

b) 1 to 10 weight % bromide-releasing compound;

c) 0.001 to about 50 weight % alkalinity source;

d) 0.001 to about 10 weight % fluorescent whitening agent; and (ii) addition to said aqueous wash liquor of a fabric work;

wherein said step (i) and step (ii) may be performed in any order or may be performed simultaneously; wherein said bromide-releasing compound provides between 0.5 to about 1.0 moles of bromide ion per mole of available chlorine in said solution; wherein said solution increases the measured textile whitening performance on said fabric work versus a control by a ΔW value of greater than about 3.0; wherein said fabric work comprises at least one cotton or cellulosic textile treated with a fluorescent whitening agent; wherein said each fluorescent whitening agent is not hypohalite bleach stable; wherein said solid composition is selected from the group consisting of a granule, tablet, and combinations thereof.

13. A method of preparing an aqueous bleaching solution with improved textile whitening performance, said method comprising:

(i) addition to an aqueous wash liquor of a solid composition comprising:

a) 10 to about 90 weight % hypohalite-generating compound;

b) 1 to about 90 weight % bromide-releasing compound;

c) 0.001 to about 10 weight % fluorescent whitening agent;

d) optionally, 0.001 to about 50 weight % alkalinity source;

wherein said bromide-releasing compound provides between 0.5 to about 1.0 moles of bromide ion per mole of available chlorine in said solution, and wherein said solution increases the measured textile whitening performance versus a control by a ΔW value of greater than about 3.0, wherein said fluorescent whitening agent is not hypohalite bleach stable; wherein the physical form of said solid composition is selected from the group consisting of a granule, tablet, and combinations thereof.

14. The method of claim 13 wherein said hypohalite-generating compound is selected from the group consisting of hypohalite salts of potassium, lithium, calcium and magnesium; chlorinated trisodium phosphate, chlorinated trisodium polyphosphate, chlorinated trisodium phosphate dodecahydrate, and chlorinated, brominated and chlorobrominated derivatives of haloamines, haloimines, haloimides, haloamides, hydantoins, uracils, triazines, isocyanurates, cyanuric acids, succinimides, malonimides, phthalamides and naphthalimides; and mixtures thereof;

wherein said bromide-releasing agent is selected from the group consisting of an alkali metal bromide salt, an alkaline earth metal bromide salt, and mixtures thereof;

wherein said fluorescent whitening agent is selected from the group consisting of derivatives of stilbene, pyrazoline, coumarin, carboxylic acid, methinecyanines, dibenzothiphene-5, 5-dioxide, azoles, 5- and 6-membered-ring heterocycles, and combinations thereof.

* * * * *